United States Patent [19]

Shibuya et al.

[11] Patent Number: 4,741,633

[45] Date of Patent: May 3, 1988

[54] IMAGE FORMING APPARATUS

[75] Inventors: Kunihiro Shibuya, Kanagawa; Kunio Hara, Chiba, both of Japan

[73] Assignee: Kabushiki Kaisha Toshiba, Kawasaki, Japan

[21] Appl. No.: 746,661

[22] Filed: Jun. 20, 1985

[30] Foreign Application Priority Data

Jun. 30, 1984 [JP] Japan ..... 59-136069

[51] Int. Cl.[4] ..... B41J 3/46; B41J 3/20

[52] U.S. Cl. ..... 400/85; 400/120; 346/76 PH; 219/216

[58] Field of Search ..... 400/118, 120, 83, 84, 400/85; 346/76 PH; 219/216

[56] References Cited

U.S. PATENT DOCUMENTS

| | | | |
|---|---|---|---|
| 1,942,008 | 1/1934 | Smith | 400/191 X |
| 3,545,373 | 12/1970 | Spaulding | 400/85 X |
| 4,410,897 | 10/1983 | Moriguchi et al. | 346/76 PH |
| 4,447,818 | 5/1984 | Kurata et al. | 346/76 PH |
| 4,527,171 | 7/1984 | Takanashi et al. | 346/76 PH |
| 4,542,387 | 9/1985 | Nagashima et al. | 400/120 X |
| 4,547,783 | 10/1985 | Watanabe | 400/120 X |
| 4,551,729 | 11/1985 | Kubo et al. | 400/120 X |
| 4,568,951 | 2/1986 | Hasegawa et al. | 400/120 X |
| 4,606,267 | 8/1986 | Wessel et al. | 400/120 X |

FOREIGN PATENT DOCUMENTS

| | | | |
|---|---|---|---|
| 95582 | 7/1980 | Japan | 400/120 |
| 154185 | 12/1980 | Japan | 346/76 PH |
| 58-98746 | 12/1983 | Japan | 400/120 |
| 59-8473 | 7/1984 | Japan | 400/120 |
| 155070 | 9/1984 | Japan | 400/83 |

OTHER PUBLICATIONS

IBM Tech. Disc. Bulletin, "Serial Display Device", Mouehan, vol. 11, No. 9, Feb. 1969, pp. 1117–1118.

IBM Tech. Disc. Bulletin, "Typewriter-Like Photoprinter", Noell et al., vol. 11, No. 11, Apr. 1969, pp. 1486–1487.

IBM Tech. Disc. Bulletin, "Thermosensitive Display with Improved Operational Characteristics", Pennington, vol. 24, No. 3, Aug. 1981, pp. 1568–1569.

*Primary Examiner*—Edgar S. Burr
*Assistant Examiner*—James R. McDaniel
*Attorney, Agent, or Firm*—Cushman, Darby & Cushman

[57] ABSTRACT

An image forming apparatus with a color agent coated supply medium, a first recording medium and a second recording medium. The color agent is transferred selectively to the first recording medium to form a first pattern on the color agent supply medium and a second pattern on the first recording medium. One of the patterns is used for displaying and the other is transferred to the second recording medium for recording.

4 Claims, 4 Drawing Sheets

IMAGE FORMING APPARATUS

BACKGROUND OF THE INVENTION

1. Field of the Invention

This invention relates to image forming devices for displaying and forming an image. The invention includes both apparatus for and method of forming an image.

2. Description of the Prior Art

A facsimile or the type of digital copying machine known as an office automation apparatus has a display section for displaying images and a recording section for printing the images as a hard copy. Also, most computer systems include an output display or an output printer as a terminal device.

A problem exists, however, in that the flickering of the displayed image excessively fatigues the operator's eyes since output displays as man-machine interfaces mainly are CRTs or the like.

Furthermore, it is a problem that the construction of the system is complicated since the display section and the record section or the output display and the output printer are independent.

SUMMARY OF THE INVENTION

The present invention provides a single solution to these problems in an image forming apparatus. In the present invention, a color agent coated on a color agent supply medium is selectively transferred to a first recording medium, and the part of the color agent remaining on the color agent supply medium forms a first pattern. Either the first pattern or the second pattern formed on the first recording medium is used for recording, and the other pattern is used for displaying.

BRIEF DESCRIPTION OF THE DRAWINGS

These and other objects and advantages of this invention will become apparent and more readily appreciated from the following detailed description of the presently preferred exemplary embodiment taken in conjunction with the accompanying drawings, of which.

DETAILED DESCRIPTION OF THE PRESENTLY PREFERRED EXEMPLARY EMBODIMENTS OF THIS INVENTION

Figure 1:
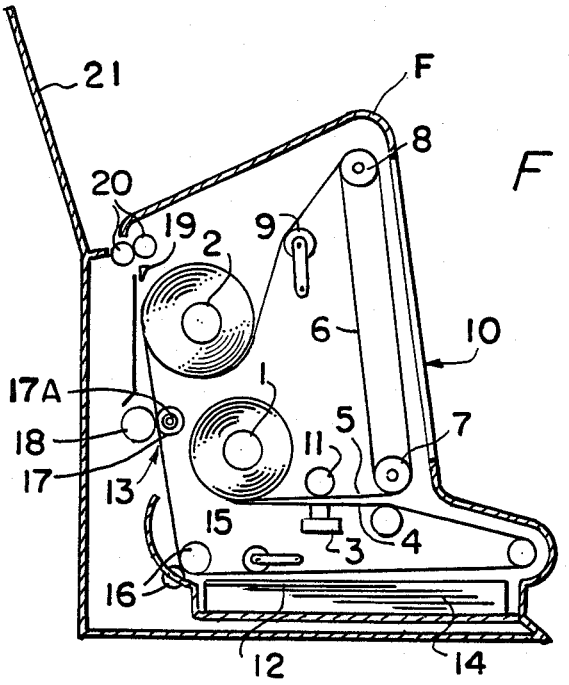
FIG. 1 is a view explaining an apparatus of one embodiment relating to the present invention.
Figure 2:
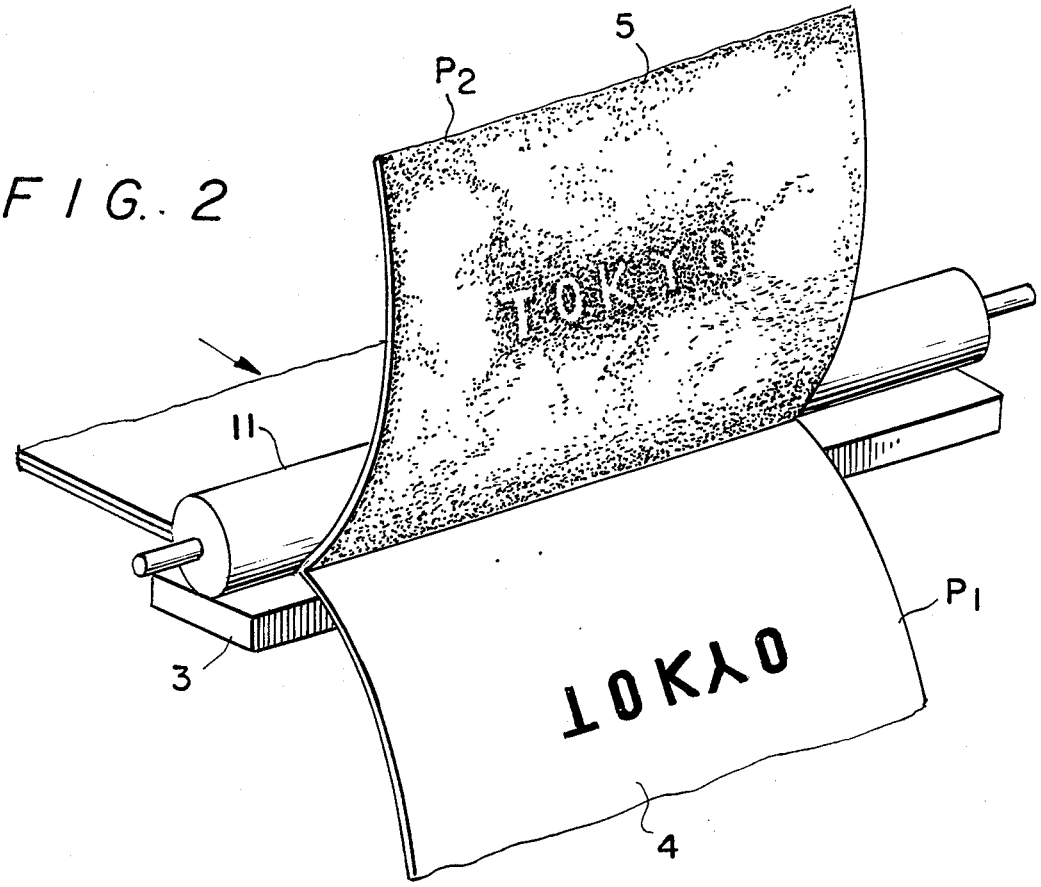
FIG. 2 is a perspective view of a thermal head and the vicinity in the apparatus.
Figure 3:
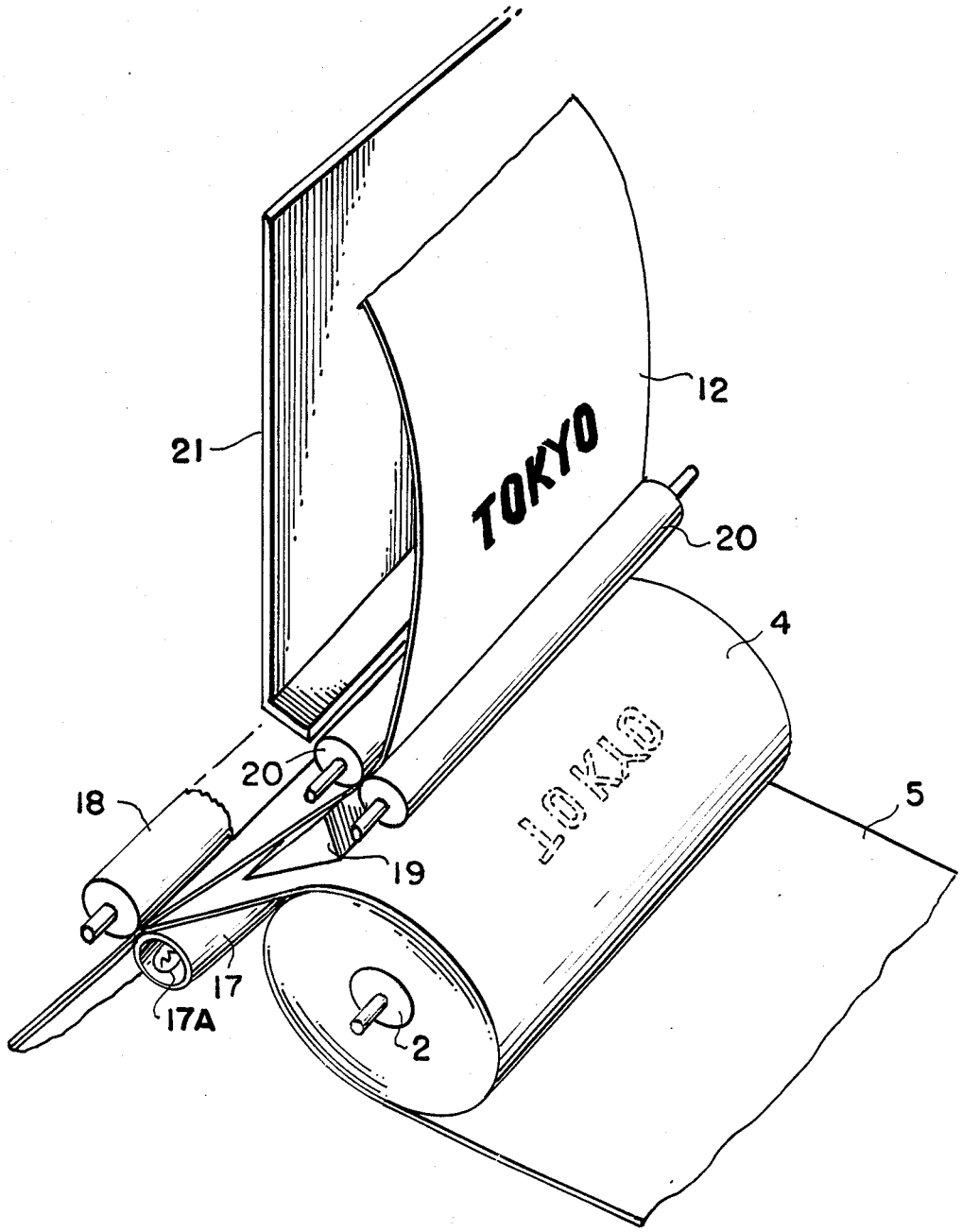
FIG. 3 is a perspective view of a thermosetting roller and the vicinity in the apparatus.

Referring to FIGS. 1 to 3, a color agent supply medium such as black ink coated ribbon 4, and a first recording medium such as transfer ribbon 5 are wound one upon another on ribbon feed roller 1, with the black ink extending between the two ribbons. On winding roller 2, used ink ribbon 4 and transfer ribbon 5 are wound through different routes. Both rollers 1 and 2 are driven by a conventional drive system (not shown).

Before separation, ink ribbon 4 and transfer ribbon 5 pass between platen roller 11 and thermal head 3. Thermal head 3 is positioned on the side of ink ribbon 4 and a plurality of heat elements are arranged side by side across the ribbons, for example to a width of A4 size (Japanese industry standard) paper. Such paper is 216 mm wide and 12 elements/mm are provided. When an image signal such as a letter signal "TOKYO" is applied from outside to a control circuit (not shown) the heat elements are selectively actuated in such a manner that color agent forming first pattern P1 of letters "TOKYO" reversed from right to left remains on ink ribbon 4 as shown in FIG. 2, and the remainder of the agent transferred to transfer ribbon 5 to form a second pattern P2 containing the letters "TOKYO" reversed from black to white. Thermal head 3 is an example of a kind of printing head in which the color agent is selectively transferred to a first recording medium from the color agent supply medium to form the first pattern by the color agent remaining on the color agent supply medium and to form a second pattern by the color agent transferred to the first recording medium.

Transfer ribbon 5 formed with second pattern P2 as mentioned above passes along one side of endless white belt 6 tension spread between belt rollers 7 and 8. On the front of white belt 6 (the right side in FIG. 1), a display such as window 10 is provided to allow visual observation of second pattern P2 from outside casing F. Tension roller 9 contacts transfer ribbon 5 to ensure close contact of ribbon 5 with white belt 6.

Conventional transfer assembly 13 transfers and records first pattern P1 remaining on ink ribbon 4 after separation from transfer ribbon 5 by transfer to a second recording medium such as cut paper 12. Transfer assembly 13 includes paper supply cassette 14, paper feed roller 15, holding and transporting rollers 16, heat fusing roller 17, backup roller 18, separation claw 19, paper discharge rollers 20 and discharge tray 21. Paper supply cassette 14 is detachably arranged in casing F and contains cut paper 12. Paper feed roller 15 is vertically shiftable and rotatably driven on paper supply cassette 14 and ink ribbon 4, and descends in response to a hard copying signal to push down ink ribbon 4 onto the top layer of cut paper 12 and transports cut paper 12 forward. Rollers 16 hold and advance transported cut paper 12 and ink ribbon 4.

Heat fusing roller 17 contains a conventional heater 17A for transferring first pattern P1 carried on ink ribbon 4 to cut paper 12 by thermally setting the pattern thereon. Backup roller 18 faces heat fusing roller 17, and separation claw 19 separates cut paper 12 and ink ribbon 4. Paper discharge rollers 20 discharge the separated cut paper and discharge tray 21 receives the discharged cut paper.

The operation of this apparatus is as follows.

When an external image signal is applied, ink ribbon 4 and transfer ribbon 5 are paid out from ribbon supply roller 1 and run forward. At the same time, thermal head 3 is also actuated to form first pattern P1 "TOKYO" reversed from right and left as shown in FIG. 2 and transferring all the other ink to transfer ribbon 5 to form a second pattern P2 which contains the letters "TOKYO" reversed with white and black on the second transfer ribbon 5. When such transfer operation of black ink is performed for the length of one page of cut paper 12, the actuation of thermal head 3 is stopped and transfer ribbon 5 is transported forward up to the position where second pattern P2 appears in window 10 and is stopped. At this time, the portion with no black ink in second pattern P2 is shown as white letters on a black background.

When a hard copy of the image information displayed in window 10 is required, it can be obtained as follows. By bringing down paper feed roller 15, ink ribbon 4 that has first pattern P1 corresponding to second pattern P2 is pushed down to the top layer of cut paper 12, and the cut paper is fed forward together with ribbon 4. While they are held and fed between heat fusing roller 17 and backup roller 18, the black ink on ink ribbon 4 is transferred and thermally fixed to cut paper 12. As a result, a hard copy recorded with the letters "TOKYO" as shown in FIG. 3 is obtained.

On the other hand, when the hard copy is not required, paper feed roller 15 is not brought down, and first pattern P1 and second pattern P2 for the next page are formed through thermal head 3. By repeating the same operation, the formation of images corresponding to image signals can be accomplished.

Displaying and printing lines of information one by one is possible by advancing the operation in the following manner. After forming first pattern P1 and second pattern P2 for a line of an image information such as letters, ink ribbon 4 and transfer ribbon 5 are fed forward until the information on second pattern P2 appears on window 10, and platen roller 11 is detached from thermal head 3. Both ribbons 4 and 5 are rewound and patterns P1 and P2 for the next line are formed.

Therefore, both the functions of displaying image information and hard copying thereof are accomplished by an integrated, simple construction which eliminates the need for a CRT, resulting in a flickerless image display. In particular, obtaining the hard copy by transferring the ink remaining on ink ribbon 4 as first pattern P1 to the cut paper produces sharp copies.

Figure 4:
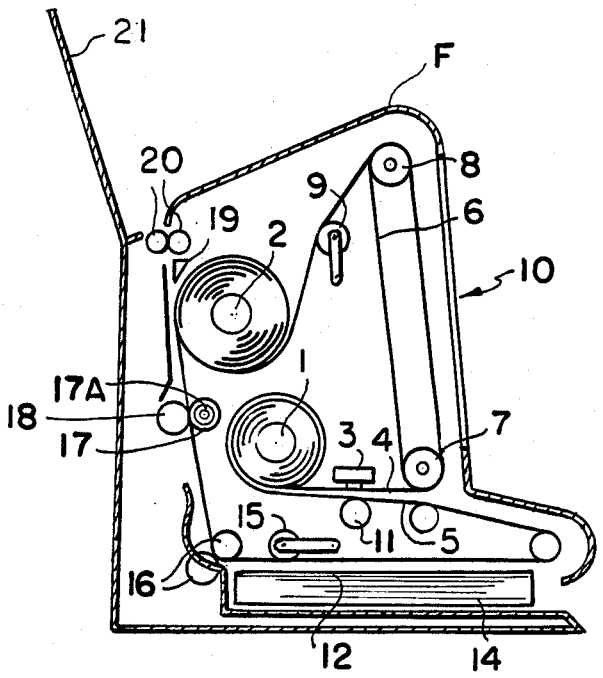
FIG. 4 is a view explaining an apparatus of another embodiment.
Figure 5:
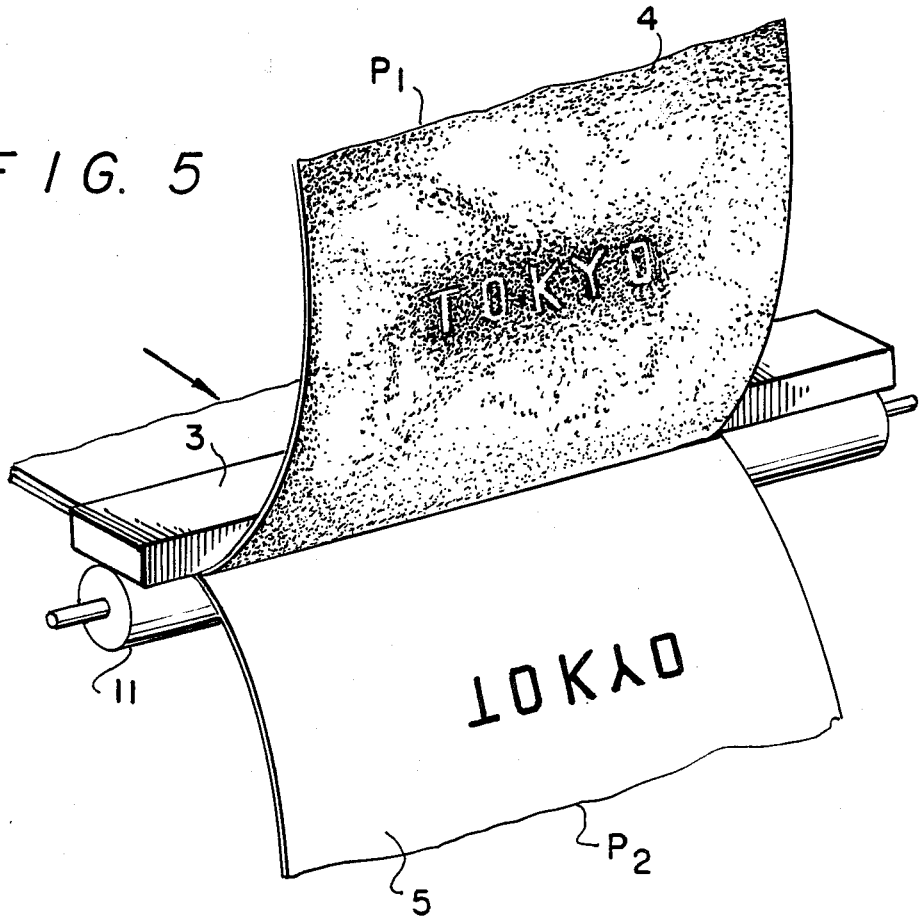
FIG. 5 is a perspective view of a thermal head and the vicinity in the apparatus shown in FIG. 4.
Figure 6:
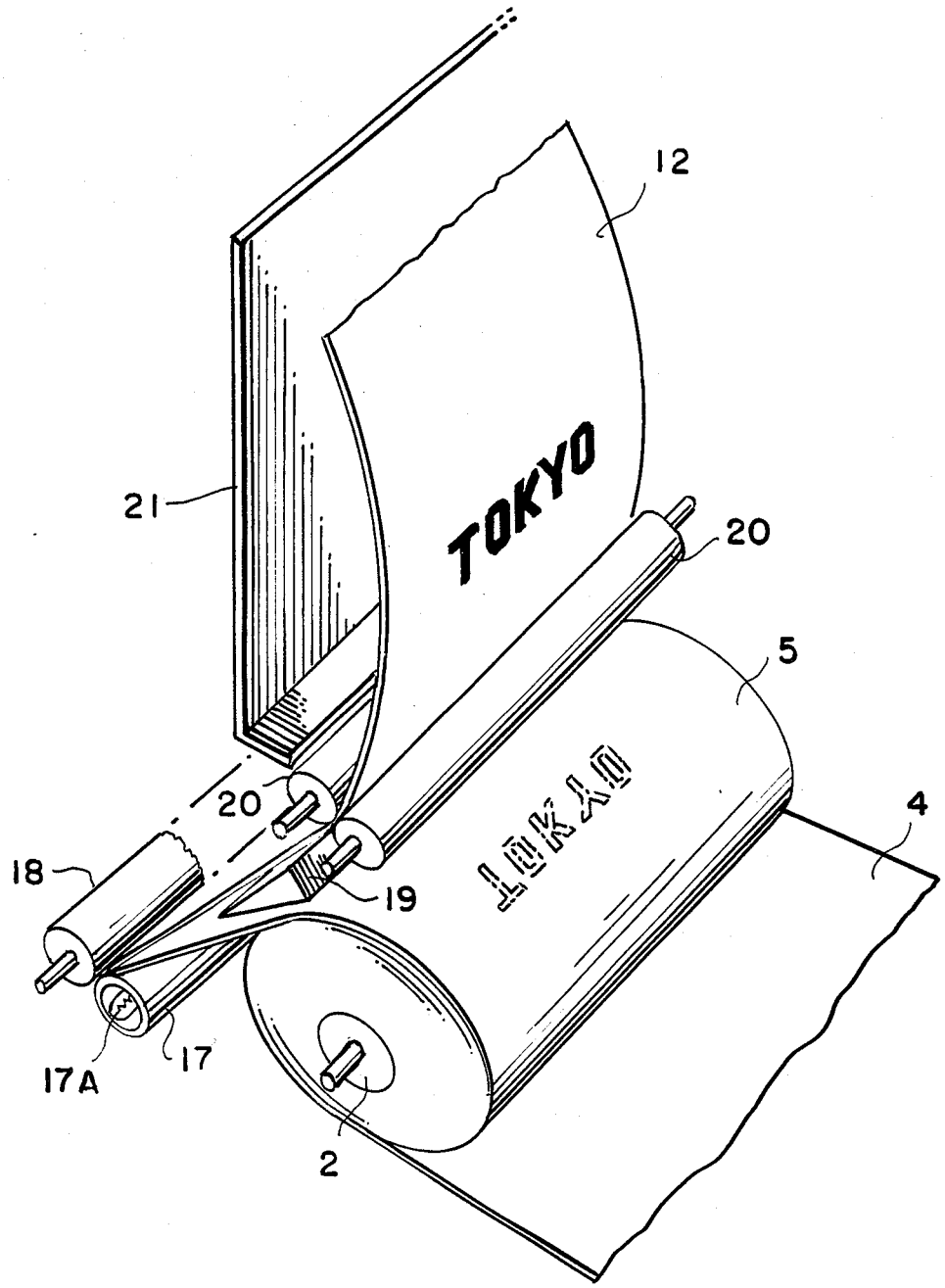
FIG. 6 is a perspective view of a heat fusing roller and the vicinity in the apparatus shown in FIG. 4.

FIGS. 4 to 6 show another embodiment which differs from FIGS. 1 to 3 in that the direction of lapping ink ribbon 4 and transfer ribbon 5 are turned upside down and, consequently, thermal head 3 is arranged on the ink ribbon side and platten roller 11 below transfer ribbon 5. When an image signal such as letter signals "TOKYO" is received from a control circuit (not shown) only the black ink corresponding to the letters "TOKYO" reversed with right and left as shown in FIG. 5 is transferred to transfer ribbon to form second pattern P2, and the black ink pattern including letters "TOKYO" remains on ink ribbon 4 to form a first pattern P1.

When an image signal is received from outside, ink ribbon 4 and transfer ribbon 5 are paid out from ribbon supply roller 1. Thermal head 3 is also actuated, and only the black ink corresponding to letters "TOKYO" reversed with right and left as shown in FIG. 5 is transferred to transfer ribbon 5 to form second pattern P2. The blank ink patterns "TOKYO" remaining on ribbon 4 forms first pattern P1. When such black ink transfer operation is made for the length of one page of a cut paper, the actuation of thermal head 3 is stopped and ink ribbon 4 is fed until first pattern P1 appears in window 10 and is stopped. At this time, the portion of the white belt having no black ink adhered is shown in white letters on a black background.

When a hard copy of the image information displayed on window 10 is required, it is obtained as follows.

By bringing down paper feed roller 15, ink ribbon 5 with second pattern P2 corresponding to first pattern P1 is pushed down onto the top layer of cut paper 12, and the cut paper is fed forward together with ribbon 5. While they are held and fed between heat fusing roller 17 and back-up roller 18, the black ink on ink ribbon 5 is transferred and thermally fixed to cut paper 12. As a result, the hard copy recorded with the letters "TOKYO" as shown in FIG. 6 is obtained.

On the other hand, when hard copies are not required, paper feed roller 15 is not brought down, and first pattern P1 and second pattern P2 for the next page are formed by thermal head 3. By repeating the same operation, the formation of images corresponding to image signals can be accomplished.

Displaying and printing lines of information one by one is possible by advancing the operation in the following manner. After forming first pattern P1 and second pattern P2 for a line of an image such as letters, ink ribbon 4 and transfer ribbon 5 are fed forward until the information on first pattern P1 appears on window 10, and platen roller 11 is detached from thermal head 3. Both ribbons 4 and 5 are rewound and patterns P1 and P2 for the next line are formed.

In the apparatus of this embodiment, only the transfer of the black ink forming the second pattern as shown in FIG. 5 to transfer ribbon 5 is required, so that the power consumption for actuating thermal head 3 and heat generation are less than for the first embodiment.

For example, a head of impact type which performs pressure transfer can be used as the printing head, and may also be used as the pressure-setting roller in the transfer section. The color agent supply medium can be replaced with one coated with other colored agents than black ink, and the base material can be colored rather than transparent. Furthermore, the base material of the first recording medium can be continuous paper.

Although only several preferred embodiments have been described in detail above, those skilled in the art will readily appreciate that many modifications are possible in the preferred embodiments without materially departing from the novel techniques and advantages of this invention. Accordingly, all such modifications are intended to be covered by this invention as described in the following claims.

What is claimed is:

1. Apparatus for printing and displaying an image pattern comprising:

a housing;

means for transferring a first pattern of a color agent from a medium coated with said agent to a first recording medium leaving a mirror image second pattern on said coated medium;

means for mounting said coated medium and said first recording medium for movement past said transferring means;

a visual display area;

means for separating said coated medium and first recording medium and directing said first recording medium to said display area;

means for transferring said mirror image pattern on said coated medium to a second recording medium to produce a hard copy and means for directing said coated medium after separation from said first recording means into contact with said second recording means and separating said coating means and second recording means after contact.

2. An apparatus as in claim 1 wherein said transferring means includes a paper feed roller displaceable to push said coated medium in to contact with said second recording means, a heat fusing roller, and a transport roller for directing the coated medium and second recording means to said heat fusing roller.

3. An apparatus as in claim 1 wherein said transferring means includes a thermal head positioned adjacent said coated medium and a roller adjacent said first recording medium with said coated medium and first recording medium being disposed between said thermal head and roller.

4. An apparatus as in claim 1 wherein said separating and directing means includes an endless belt with said first coated medium being directed along one side thereof for viewing.

* * * * *